US011134557B2

(12) United States Patent
Bayes

(10) Patent No.: US 11,134,557 B2
(45) Date of Patent: Sep. 28, 2021

(54) DIMMABLE LIGHT SOURCE

(71) Applicant: Broseley Limited, Douglas (GB)

(72) Inventor: Kevin Bayes, Norwich Norfolk (GB)

(73) Assignee: Broseley Limited

( * ) Notice: Subject to any disclaimer, the term of this patent is extended or adjusted under 35 U.S.C. 154(b) by 0 days.

(21) Appl. No.: 16/977,032

(22) PCT Filed: Feb. 28, 2019

(86) PCT No.: PCT/GB2019/050558
§ 371 (c)(1),
(2) Date: Aug. 31, 2020

(87) PCT Pub. No.: WO2019/166812
PCT Pub. Date: Sep. 6, 2019

(65) Prior Publication Data

US 2020/0408365 A1 Dec. 31, 2020

(30) Foreign Application Priority Data

Mar. 1, 2018 (GB) ..... 1803352
Mar. 1, 2018 (GB) ..... 1803354
Mar. 15, 2018 (GB) ..... 1804162

(51) Int. Cl.

| | |
|---|---|
| ***F21K 9/238*** | (2016.01) |
| ***H05B 45/10*** | (2020.01) |
| ***F21S 9/03*** | (2006.01) |
| ***F21V 23/00*** | (2015.01) |
| ***H05B 47/19*** | (2020.01) |
| ***H05B 47/175*** | (2020.01) |
| ***H05B 45/38*** | (2020.01) |

(Continued)

(52) U.S. Cl.
CPC ..... *H05B 47/19* (2020.01); *F21K 9/238* (2016.08); *F21S 9/037* (2013.01); *F21V 23/003* (2013.01); *F21V 23/006* (2013.01); *H05B 45/38* (2020.01); *H05B 47/175* (2020.01); *F21Y 2115/10* (2016.08); *H05B 45/325* (2020.01)

(58) Field of Classification Search
CPC ..... F21K 9/238; H05B 47/175; H05B 47/19; H05B 45/10; F21V 23/006; F21V 23/003; F21S 9/037
See application file for complete search history.

(56) References Cited

U.S. PATENT DOCUMENTS 9,420,644 B1 * 8/2016 Shum ..... F21V 23/003
9,657,928 B1 5/2017 Jacobson
(Continued)

FOREIGN PATENT DOCUMENTS

EP 3001093 3/2016
WO 2013108187 7/2013
(Continued)

OTHER PUBLICATIONS

International Search Report and Written Opinion for Application No. PCT/GB2019/050558 dated Jun. 3, 2019.

*Primary Examiner* — Tracie Y Green
(74) *Attorney, Agent, or Firm* — Tumey L.L.P.

(57) ABSTRACT

A dimmable light-emitting device, comprises a LED light source; a base assembly configured to fit a light-bulb socket, the base assembly comprising a hollow portion; a LED control circuit for dimming the LED light source, the LED control circuit entirely housed within the hollow portion.

5 Claims, 23 Drawing Sheets

(51) Int. Cl.
*F21Y 115/10* (2016.01)
*H05B 45/325* (2020.01)

(56) References Cited

U.S. PATENT DOCUMENTS

| | | | | |
|---|---|---|---|---|
| 2008/0180036 | A1 | 7/2008 | Garrity et al. | |
| 2009/0184618 | A1* | 7/2009 | Hakata | H01L 25/0753 313/1 |
| 2010/0277067 | A1* | 11/2010 | Maxik | F21V 3/00 315/32 |
| 2011/0037387 | A1* | 2/2011 | Chou | F21V 29/83 315/35 |
| 2013/0193879 | A1* | 8/2013 | Sadwick | H05B 45/3725 315/307 |
| 2015/0109781 | A1* | 4/2015 | Van Der Merwe | F21V 23/006 362/249.01 |
| 2016/0066386 | A1* | 3/2016 | Catalano | H05B 45/50 315/309 |
| 2016/0088693 | A1* | 3/2016 | Zhao | F21V 23/006 315/51 |
| 2018/0066811 | A1* | 3/2018 | Knapp | F21K 9/66 |
| 2018/0328543 | A1* | 11/2018 | Bergmann | H05B 45/3577 |
| 2021/0045203 | A1* | 2/2021 | Bayes | H05B 45/10 |

FOREIGN PATENT DOCUMENTS

| | | |
|---|---|---|
| WO | 2013153522 | 10/2013 |
| WO | 2016145448 | 9/2016 |
| WO | 2017127836 | 7/2017 |

* cited by examiner

| App setting number | 230V mains (198-203) | 110V |
|---|---|---|
| 10 | 22 | 12 |
| 20 | 39 | 22 |
| 30 | 59 | 32 |
| 40 | 76 | 42 |
| 50 | 92 | 52 |
| 60 | 112 | 62 |
| 70 | 130 | 71 |
| 80 | 149 | 82 |
| 90 | 167 | 91 |
| 100 | 180 | 98 |
| | | |

| App setting number | Current |
|---|---|
| 2 | 0.02 |
| 3 | 0.06 |
| 4 | 0.08 |
| 5 | 0.14 |
| 6 | 0.15 |
| 7 | 0.16 |
| 8 | 0.17 |
| 9 | 0.20 |
| 10 | 0.26 |
| 20 | 0.38 |
| 30 | 0.76 |
| 40 | 0.96 |
| 50 | 1.38 |
| 60 | 2.41 |
| 70 | 2.92 |
| 80 | 3.15 |
| 90 | 3.62 |
| 100 | 4.21 |
| | |

DIMMABLE LIGHT SOURCE

TECHNICAL FIELD

Aspects of the invention generally relate to dimmable light sources systems. More particularly, aspects of the invention relate to dimmable light-emitting diode (LED) bulbs. Furthermore, aspects of the invention relate to dimmable light-emitting diode filament bulbs.

BACKGROUND

LED lights have been used for years in applications requiring relatively-low energy lamps. LEDs are efficient, long-lasting, cost-effective and environmentally friendly. As LED lights are increasingly and more widely used in daily life, the demand for dimmable lights has also increased.

A problem with existing dimmable LEDs is that the electronics required to control the dimming of the light are relatively large compared to the total size of the bulb, obstructing the light emitted by the light source. Furthermore, such chunky electronics are unsightly, resulting in an unusual shape of the light bulb or in part of the bulb being covered, unlike traditional incandescent light bulbs that the public is used to. This can deter users from choosing the dimmable light bulb over the more traditional light bulbs that they would typically have in their household. Wall mounted dimmers are also traditionally used, the invention therefore seeks to obviate these.

Embodiments of the present invention seek to overcome the above-mentioned problems, amongst others.

SUMMARY OF INVENTION

In an independent aspect of the invention there is provided a dimmable light-emitting device comprising:

- a LED light source;
- a base assembly configured to fit a light-bulb socket, the base assembly comprising a hollow portion;
- a LED control circuit for dimming the LED light source, the LED control circuit being entirely housed within the hollow portion.

Advantageously, all of the control electronics are fully housed within the base assembly of the lightbulb, and do not protrude within the bulb housing the filament, therefore exposing as much of the light as possible. This obviates the need for a cover of the light bulb.

Preferably, the base assembly is configured to fit a screw portion.

In a further subsidiary aspect, the base assembly is configured to fit a bayonet portion.

Preferably, the base assembly is configured to fit an E26 or E27 light bulb socket. The dimmable light-emitting device therefore may be made to look like a traditional light bulb and appeal aesthetically to the general public. E26/230 V bulbs are used in Europe, while the E26/110V are used in the USA.

Preferably, the device further comprises a power source electrically connected to the LED control circuit, wherein the LED control circuit is powered exclusively by the power source. That is, the LED control circuit does not draw power from the mains which power the LED source. This has a number of advantages, including:

- The device can be more easily configured to provide the power required.
- A clean isolation barrier is provided between low voltage and mains voltage.

For example, the power source may be comprised within the hollow portion of the base assembly.

In one embodiment, the power source is a photovoltaic (PV) cell facing the LED light source. For example, the PV cell may be made from PV tape that is easy and convenient to include within the base assembly. This advantageously captures enough power for topping up a battery that powers the LED control circuit.

Preferably, the device further comprises a network communications board (optionally Bluetooth) for remotely controlling the dimmable light-emitting device. This enables the device to be remotely controlled, for example via a mobile phone application.

Optionally, the network communications board has DALI (Digital addressable lighting interface) compatibility. DALI compatibility allows control of the device at least partially via mains power.

In some embodiments, the network communications board comprises the LED control circuit. That is, the communication and control boards are on the same board. Alternatively, the network communications and LED control circuits are on separate boards. Separating or de-coupling the communications board from the dimming board has a number of advantages over an integrated board, including:

- Increased robustness and minimum electrical disturbance.
- Additional space on the PCB provides options for design and manufacture testing which otherwise would not be possible to incorporate.

In preferred embodiments, the power source is located between the network communications and LED control circuit boards. In other words, the battery is 'sandwiched' between the two boards. For example, the battery is planar and in parallel planes relative to the two boards either side of the plane of the battery. This sequence or configuration minimises space for fitting in a typical light bulb base, at the same time enabling a robust and remotely controllable dimming of the device.

In a particularly preferred embodiment, there is provided a dimmable light-emitting device, comprising:

- a LED light source;
- a base assembly configured to fit a light-bulb socket, the base assembly comprising a hollow portion;
- a LED control circuit for dimming the LED light source, the LED control circuit being entirely housed within the hollow portion;
- a power source electrically connected to the LED control circuit, wherein the LED control circuit is powered exclusively by the power source;
- wherein said base assembly comprises a circumferential wall configured to fit a light-bulb socket; said circumferential wall having at its distal extremity a rim; said rim defining an end of said base assembly; a first board being exposed for receiving wireless communications through the space defined by said rim; and a second board located behind said first board and incorporating said LED control circuitry for dimming said LED light source, wherein the power source is located between the first and second boards; both the power source and the second board being located below the rim of said circumferential wall.

In some embodiments, there is provided a control device for dimming a dimmable light-emitting device as described above, the control device comprising a network communications board disposed in parallel to a LED control circuit board, the control device further comprising a power source for exclusively powering the LED control circuit board, the power source being located between the network communications board and the LED control circuit board.

In some embodiments, a universal dimmer comprises a control device as described above. This advantageously enables control and dimming of further light sources.

BRIEF DESCRIPTION OF THE FIGURES

The invention will be described by reference to the following figures, in which.

DETAILED DESCRIPTION

In the following text, the terms "light-emitting device", "light source", "light bulb" and "lamp" may be used interchangeably to refer to a variety of light source configuration.

Figure 1:
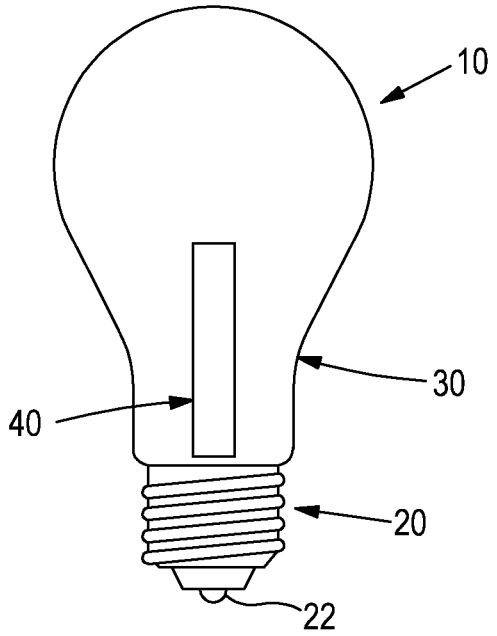
FIG. 1 schematically shows a light source.

FIG. 1 shows schematically a LED lamp 10 for replacing an incandescent bulb in a common household light bulb socket. The lamp 10 has a base assembly 20 having a hollow cylindrical portion, a bulb assembly 30 and a LED source 40. The LED is powered from the mains via the base assembly 20. The bulb assembly 30 is preferably made from a transparent material such as glass.

The base assembly 20 is made from a suitable metallic material and is configured to fit an E26 or E27 light bulb socket. The light bulb socket has inner threads which correspond to threads 21 on lamp 10. The base assembly 20 preferably looks the same as a "screw" of a typical light bulb. The tip 22 of the base assembly 20 touches a contact in the bottom of the light bulb socket when lamp 10 is fully screwed into the socket to power the LED from the mains.

Figure 2:
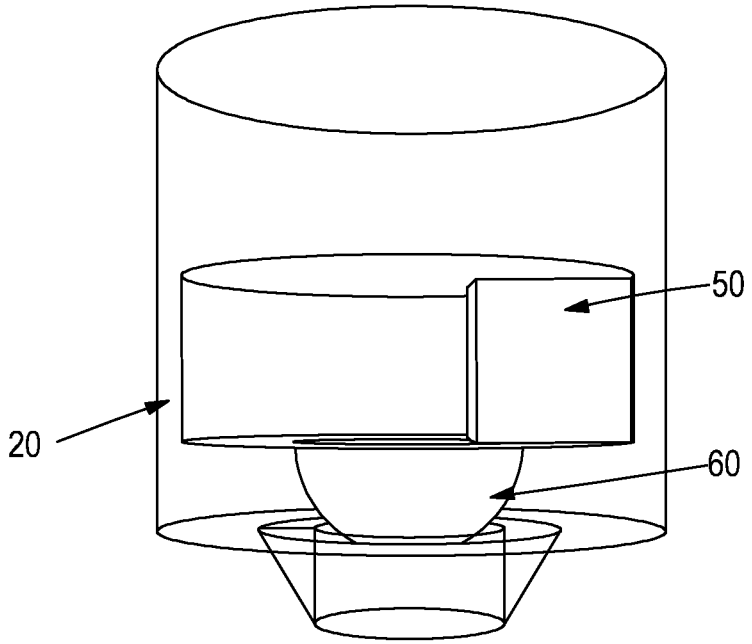
FIG. 2 shows a space model for "dimmer on board", DoB, electronics within a E27 light bulb base.

As schematically shown in FIG. 2, the base assembly 20 houses the electronics of the lamp, including a "dimmer on board" DoB in space 50, so that the LED 40 is exposed as much as possible. In this example, the dimmer used is a 4 W 2-step dim PCB (printed circuit board). The space 50 made available inside the base assembly 20 fully houses the DoB electronics including a varistor component of the 2-step dim PCB.

Space 50 therefore represents a "keep-out" region for dimmer electronics and extends more roughly to the base of the usable space. The small dome 60 shown at the bottom of the rim portion (or base) of the base assembly 20 is shown for completeness but is not envisaged to house electronics due to the relatively small volume and a requirement for electrical connection through the centre of the dome and through tip 22.

Figure 3:
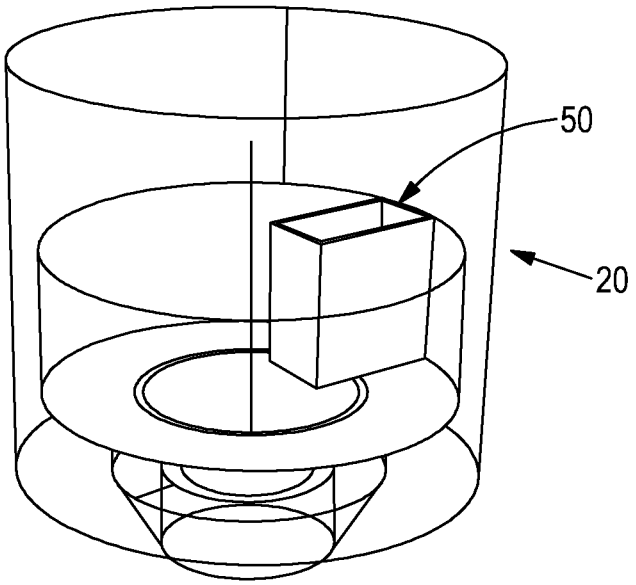
FIG. 3 shows a perspective view from above of the space model of FIG. 2.
Figure 4:
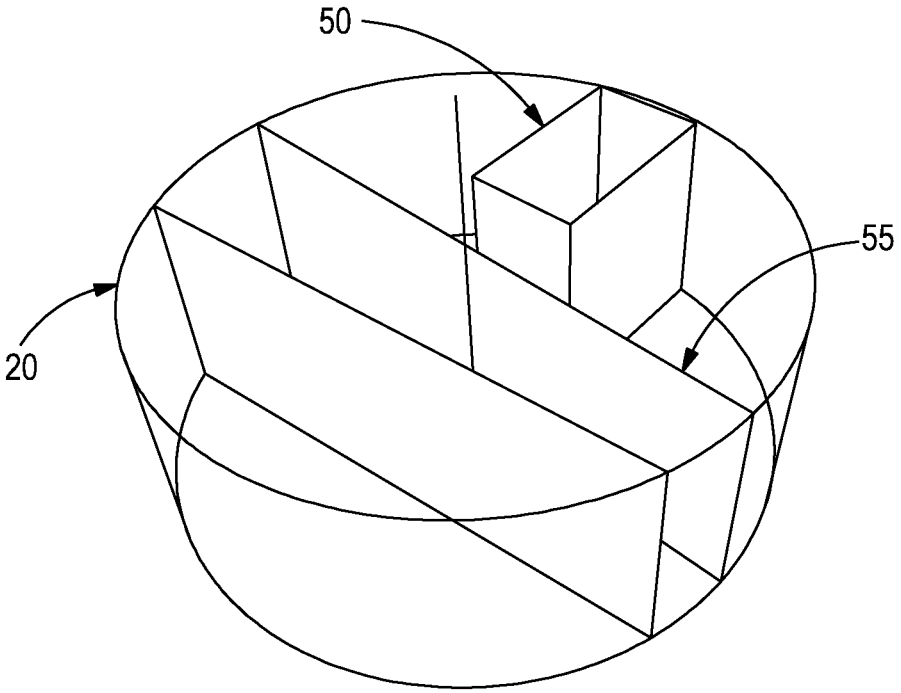
FIG. 4 shows a space model for printed circuit boards (PCB)
Figure 5A:
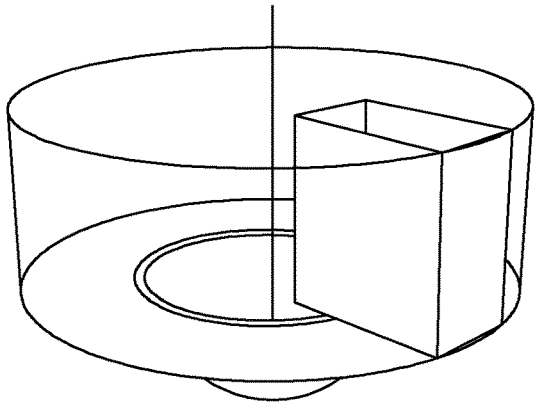
FIGS. 5A to 5C show further models of a space model for DoB electronics within a light bulb base.
Figure 5B:
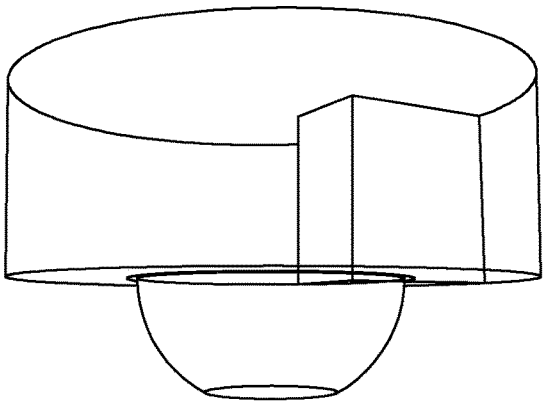
Figure 5C:
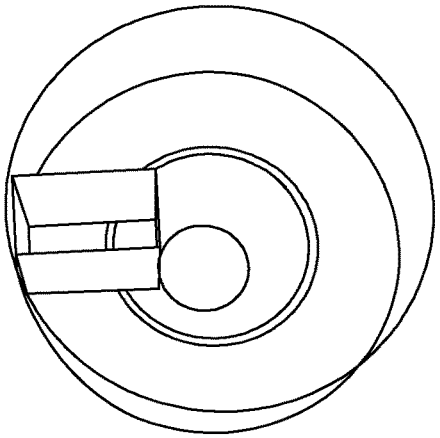

FIG. 3 is a perspective aerial view of the base assembly 20 of FIG. 2. Indicated in FIG. 4 is a PCB area 55. Between 1 to 3 PCBs may advantageously fit in the proposed PCB area 55.

While the varistor is not fitted to the 5.6 W variant, the components on this version of the 2-step dim PCB are mounted on the underside, with the top side left clear. This could be inverted using a 4 W or else an additional clearance will be required from the 2-step dim circular board face; 1.2 mm for one half of the 2-step dim PCB and 2.8 mm on the other half.

Figure 11:
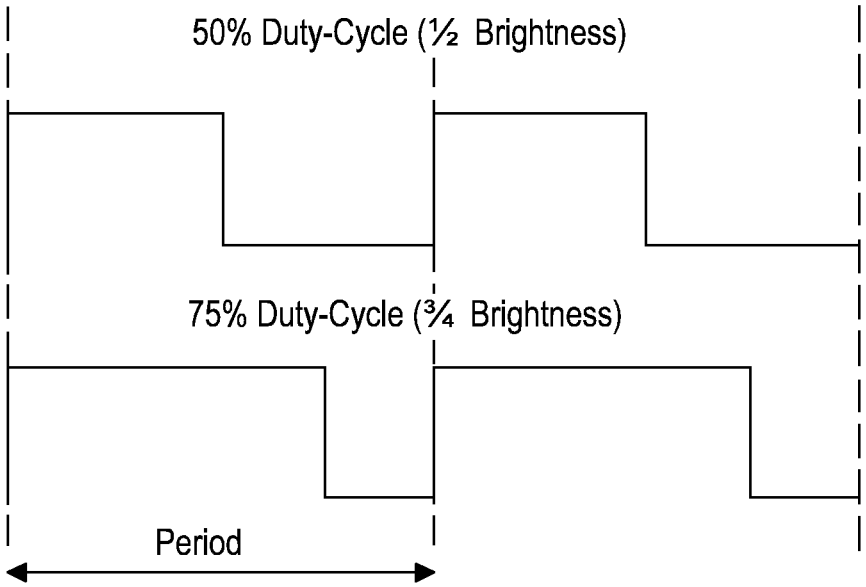
FIG. 11 shows examples of pulse-width modulated (PWM) signals by DC electronics for driving the dimming of a LED.

The dimming of the LEDs is driven by DC (direct current) electronics using a pulse-width modulated (PWM) signal. The level of dimming at any particular time is defined by the duty-cycle of the PWM signal, which is simply the amount of time in a period that the signal is "on" for. An example of PWM signal is shown in FIG. 11. The PWM signal is used to "chop" the AC signal feeding the LED driving circuitry, thus dimming them. The PWM signal is produced by a timer in a microcontroller (MCU), which is itself software controlled.

Optionally, network control of the lamp is possible. In preferred embodiments, wireless communication for remote operation of the DoB is envisaged. In particular, a multi-protocol, 2.4 gHz device may be used to support various protocols such as Wi-Fi, ZigBee, Thread and Bluetooth mesh (many of these being registered trade marks). Bluetooth is preferable to connect to a mobile device such as mobile phone for example. Bluetooth, traditionally, is a paired technology whereby two devices must be connected to each other (and no one else) in order to communicate data. Bluetooth 5 mesh-networking allows a Bluetooth device to communicate with more than one other device in a wider network. Accordingly, the mesh capability of Bluetooth 5 enables grouping and control of multiple lighting devices. Pulse-width modulated (PWM) dimming with a co-processor model is preferred, whereby a "Blue Gecko" (registered trade mark) solution from Silicon Labs is used as a traditional model alongside a microcontroller (MCU). Bluetooth 5 offers an alternative to traditional network communications systems such as DALI and is of particular interest due to the availability of Bluetooth on mobile phones.

In alternative embodiments, DALI compatibility is envisaged in order to allow control at least partially via mains power. Primarily, it is a wireless network control but DALI compatibility means being able to integrate as at least part of a primarily wired controlled system. This might be to allow signals via the wires to a wireless repeater which can "speak" the DALI language which can then be understood by the lamp. In that sense, the lamp is able to understand the language but cannot itself be directly controlled via a mains contact point. For example, the MCU device may comprise a DALI stack.

A Bluetooth module may optionally connect to an external antenna. This overcomes any poor RF performance due to a "Faraday cage" effect of the metallic base assembly of the lamp. Alternatively, an internal antenna may be used to reduce cost and complexity of manufacturing.

Dimmers may include a Triac or MOSFET for example. The inventors found that PWM control and smooth dimming of a 4 W lamp is achievable for example with a S124 MCU. Preferred embodiments have no heat pipe. Nevertheless, optionally a heat protection may be included such as a thermistor for shutting off operation if the device were to overheat. A heat pipe option may also envisaged, to spread heat from the DoB to the LED/filaments or vice versa.

TESTING EXAMPLES

In an example, Bluetooth connection was set up between a mobile phone application (App) and a Bluetooth communication adapter board. With this set up, 4 W and 10 W LED bulbs may be respectively dimmed and brightened remotely via the App. During normal operation, the PWM frequency is preferably 900 Hz, up to 1 kHz.

Figure 12:
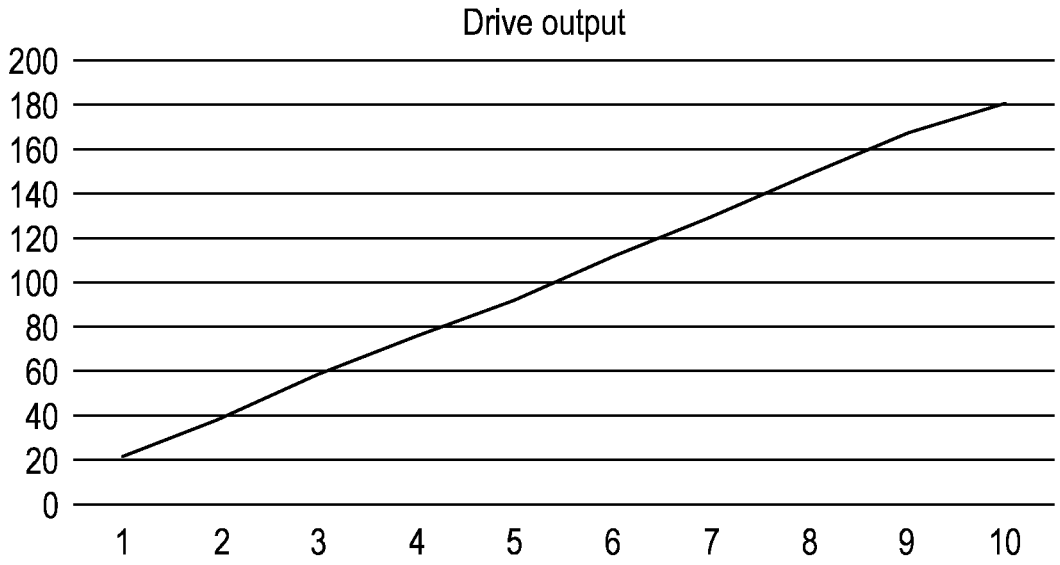
FIG. 12 shows a linear drive output from the DoB.

The bulbs may be dimmed and brightened by the DoB smoothly and without a flicker. The drive output was measured in terms of volts against a dimmer setting 10-100 in steps of 10. As shown in FIG. 12, the drive output from the DoB is output linearly, in proportion across the range.

Figures 13, 14:
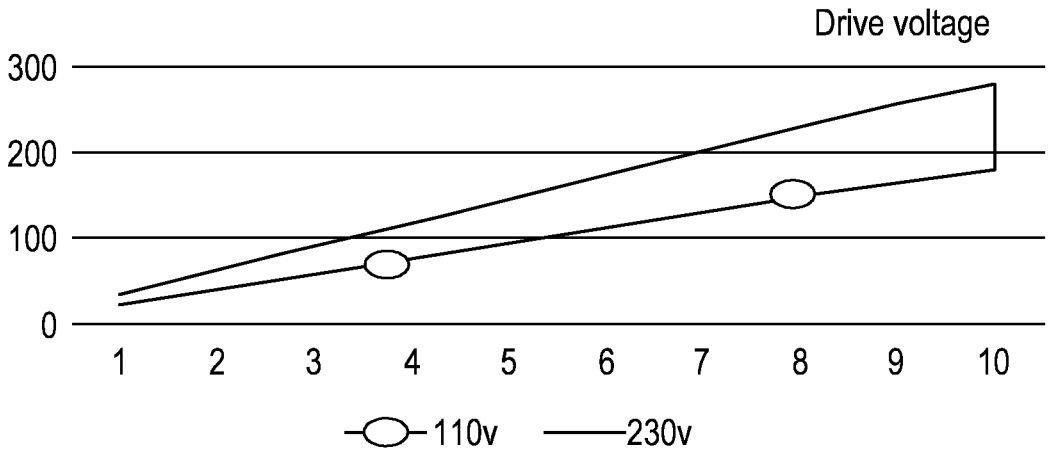
FIGS. 13 and 14 show test results for European (230V) and US (110V) drive voltages.

The DoB may be powered by both UK and US voltage supply for example. For example, the DOB may be powered via a variac set to 110V. Example results for testing the drive at both 230V and 110V are shown in the table of FIG. 13, plotted in FIG. 14. As can be seen from FIG. 14, both 110V and 230V drive voltages produced linear results.

Figures 15, 16:
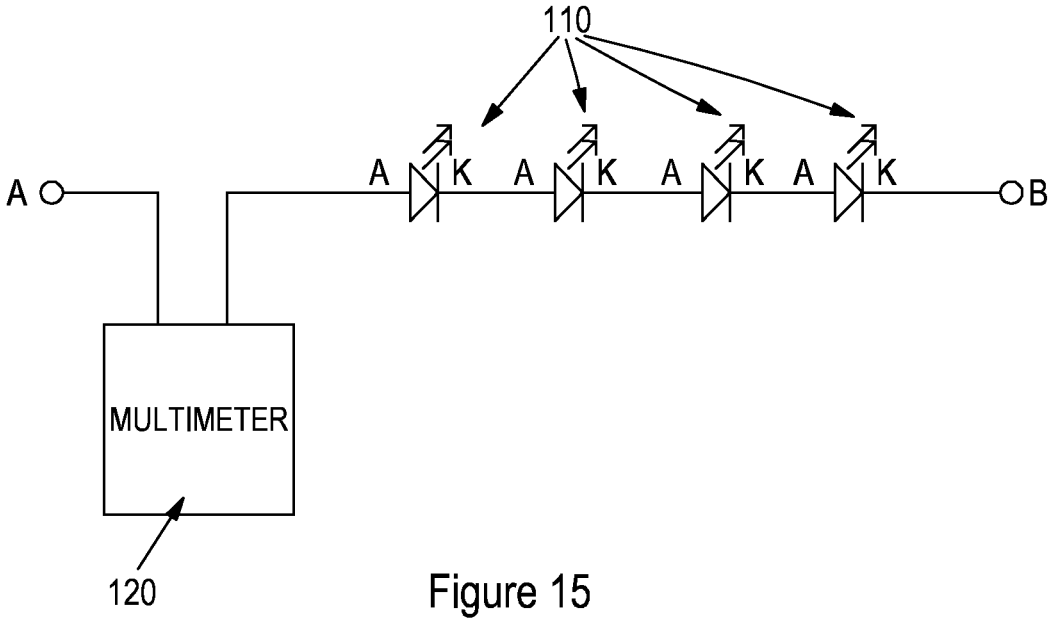
FIG. 15 is a schematic circuit diagram for a driver.
FIG. 16 is a table showing test results for the driver.

In a test example, a 4 W driver was used, with a filament wiring of 4×40 mm and a ST64-4S-E27-1800K bulb. The internal filament wiring is schematically shown in FIG. 15. In this configuration, the LED filaments 110 are all wired in series from one point (A) of the DoB to another (B), point B representing the anode of the first LED. Each LED 110 in the diagram represents a LED filament. Connecting the multimeter 220 in series in this configuration allows for measuring the voltage and the current flowing through the bulb filaments supplied by the driver. In a measurement, there was a 40V voltage across each of the filaments, resulting in 160V overall.

Figure 17:
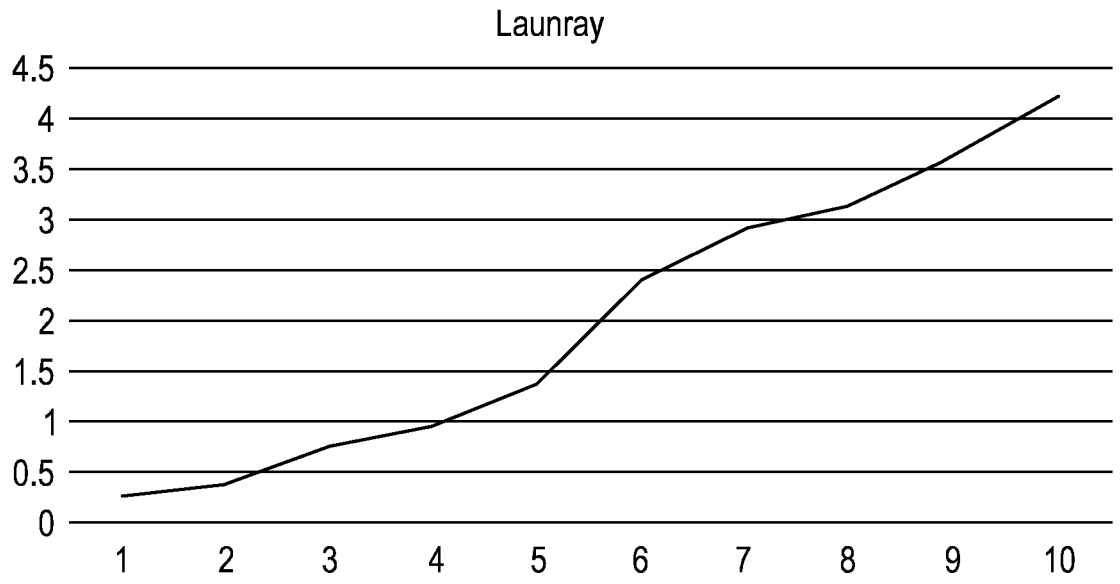
FIG. 17 shows an example driver board output.

As can be seen from the table in FIG. 16, the voltage between an App settings 0 and 10 is growing and then stabilizes. The current is increasing over the entire range. FIG. 17 shows a near linear current draw, with points 10 to 100 being represented on the graph.

In another test example, a 13 W driver was used, with a filament wiring of 4×40 mm and a ST64-4S-E27-1800K bulb.

In a significant embodiment, the dimming circuitry is powered independently to the LED/filament. That is, the dimmer does not draw power from the grid, but from a separate source. Optionally, the electronic control can draw power from the LED/filament but not from the mains.

A number of ways to harvest power for the dimming circuitry are envisaged:

Harvesting from 2-Step Dimming Circuit

A solution for harvesting from the 2-step dimming circuit would be a preferred option (requiring minimal components). It is envisaged that the 230V is stepped down by the dimming circuit, the LED filaments themselves providing a step down and rectification function.

Provision of a Step-Down Power Circuit

A standard step down and rectification circuit has been simulated which would provide the necessary power input to the circuit. This type of circuit however would require the use of large capacitors and/or resistors.

Battery Power

Using battery power essentially replaces the power as provided say from a USB connector with a battery. A small coin battery is envisaged which can be housed alongside and with the on-board dimmer. This approach has a number of advantages:

- It can easily be configured to provide the power required (power requirements could change if other communications systems such as WiFi are incorporated at a later date).
- It enables more options to fit all of the electronics to fit within a E26/E27 base assembly.
- The DoB is decoupled from the 2-step dimming board meaning that the technology is more portable.
- A clean isolation barrier is provided between low voltage and mains voltage.

Harvesting Coupled with Battery Power

It is further envisaged to use re-chargeable batteries, a charge circuit and a source of energy. One option for the energy source is the 2-step dimming board, however this would couple the solution to the dimming board (i.e. not universal). A further, preferred, option is to use a flexible solar cell located within the base assembly 20 (within the diameter of the threaded portion) and facing the filament.

The solar cell could be made from a photovoltaic (PV) tape for example that could harvest energy from the light emitted from the LED, providing enough power to top up a battery to control the electronics. This solution offers a number of advantages including extending battery life.

In another embodiment, both the communications board and the control board are on the same board. In another embodiment, there is a communications board separate to a control board, for example sandwiching the power source. Separating or de-coupling the communications board from the dimming board has a number of advantages over an integrated board, including:

- The PCB design is more robust and provides options if required to alleviate EMC or electrical disturbance.

Additional space on the PCB provides options for design and manufacture testing which otherwise would not be possible to incorporate.

Figure 6A:
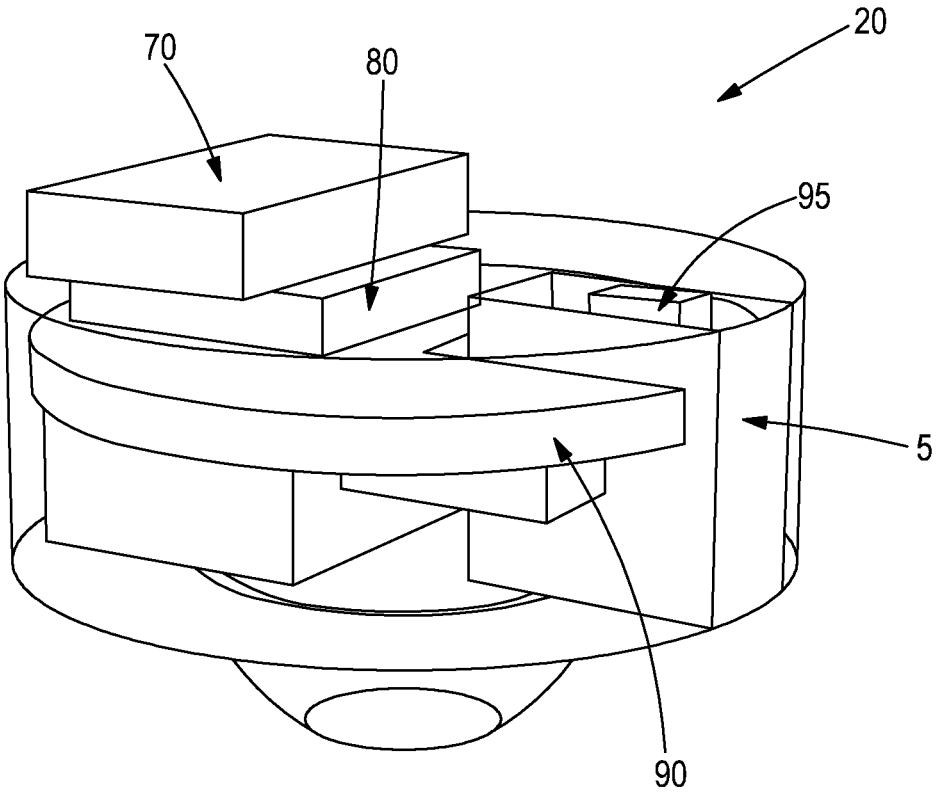
FIGS. 6A to 6C show views of a space model of DoB circuitry and battery inside a E27 light bulb base.
Figure 6B:
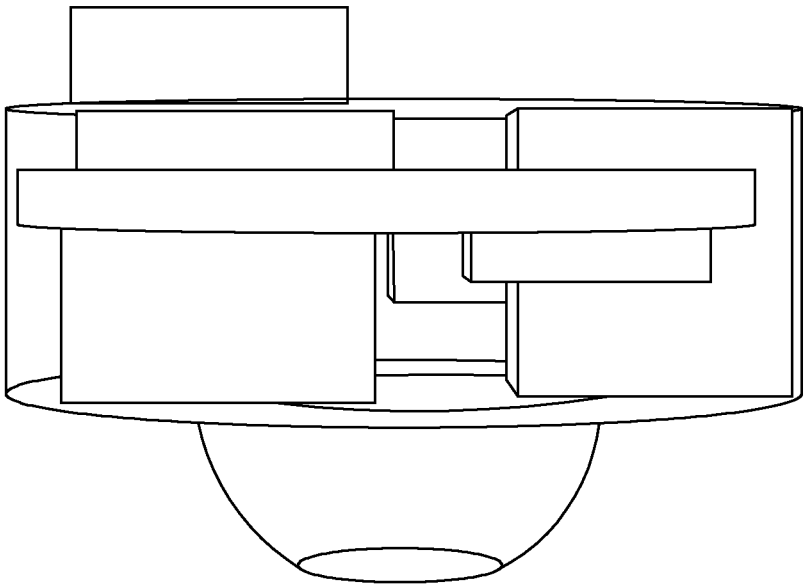
Figure 6C:
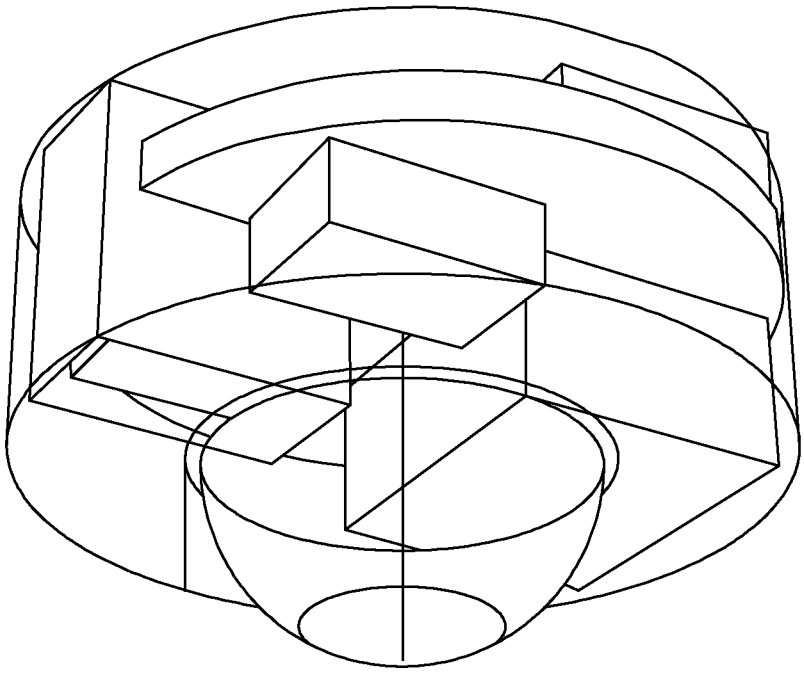
Figure 7:
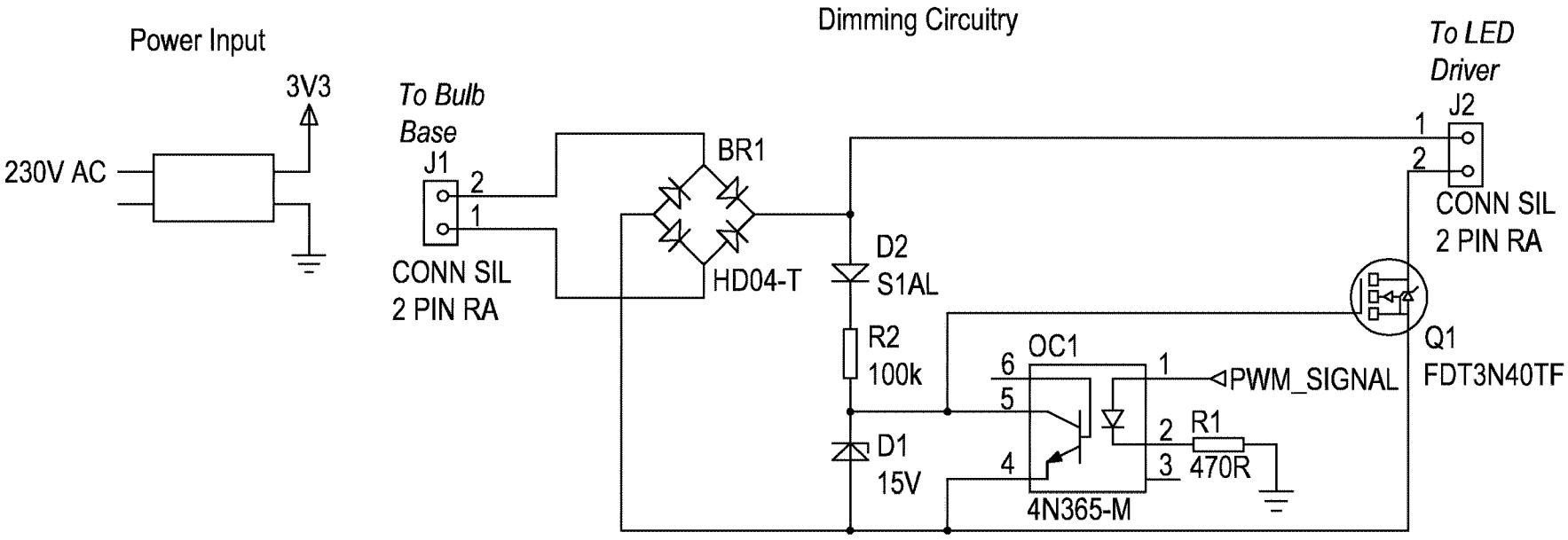
FIG. 7 shows schematically DoB circuitry.
Figure 8:
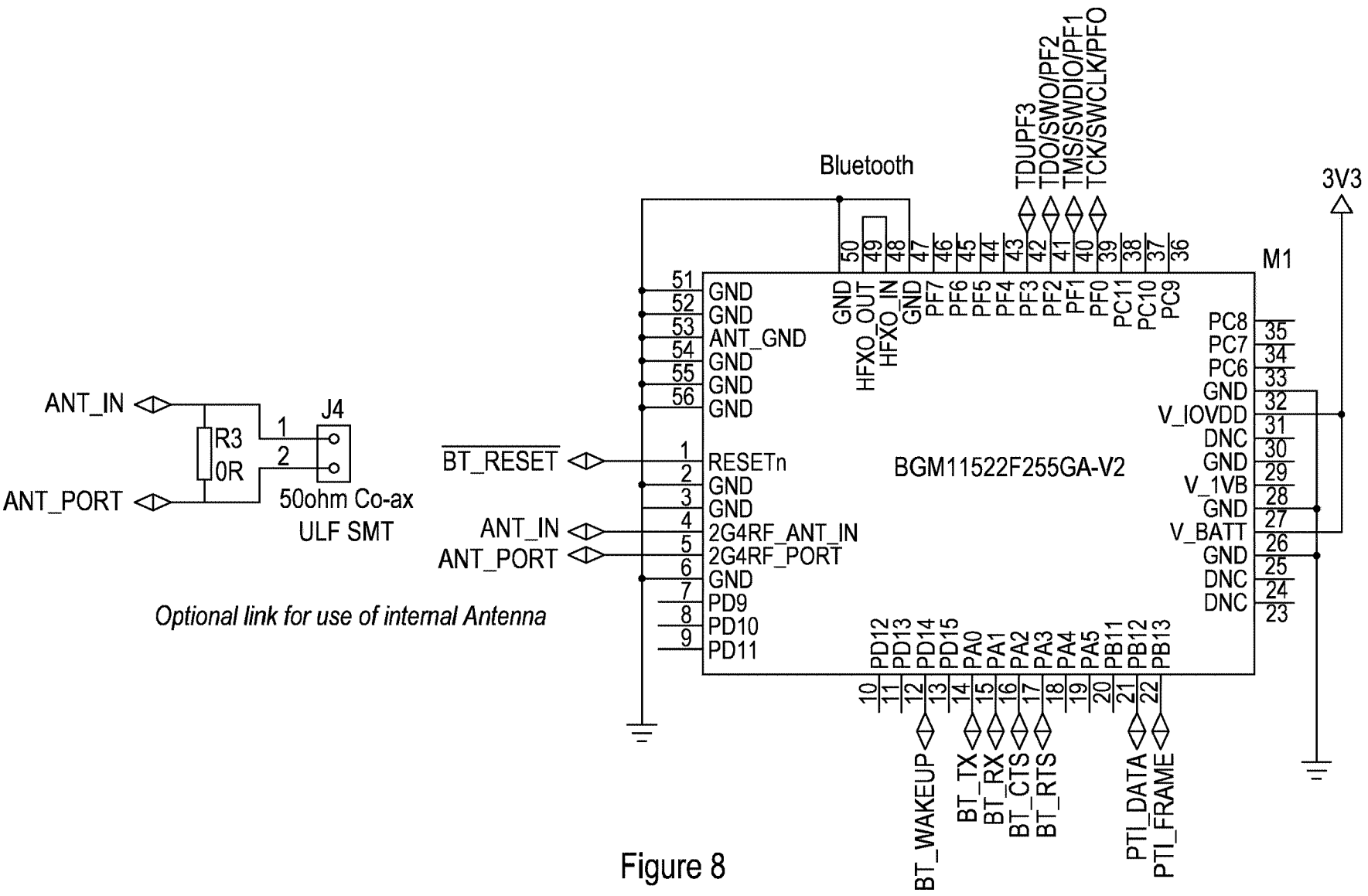
FIG. 8 shows schematically a Bluetooth circuit for the DoB.
Figure 9:
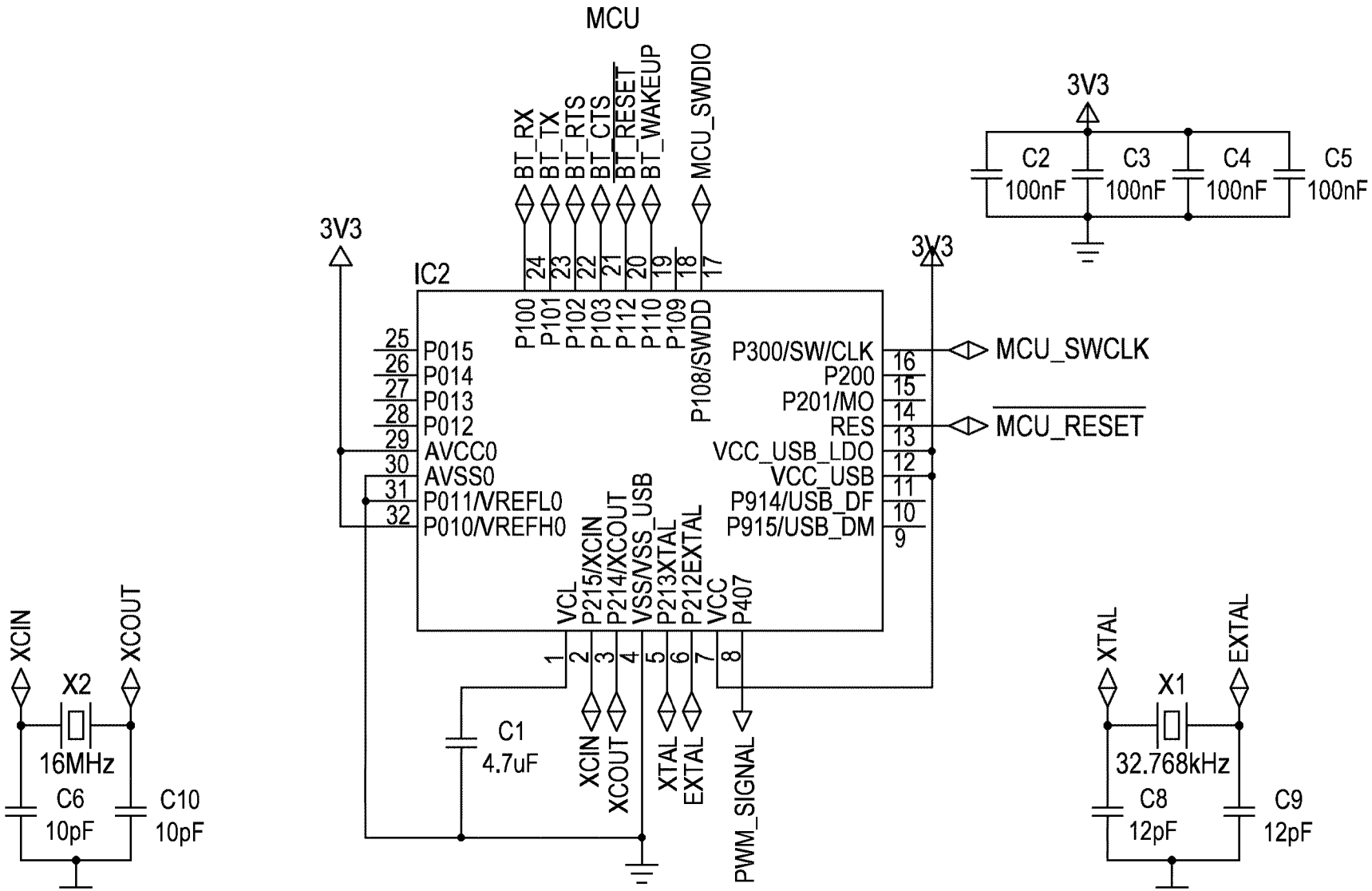
FIG. 9 shows schematically a microcontroller (MCU) circuit for the DoB.
Figure 10A:
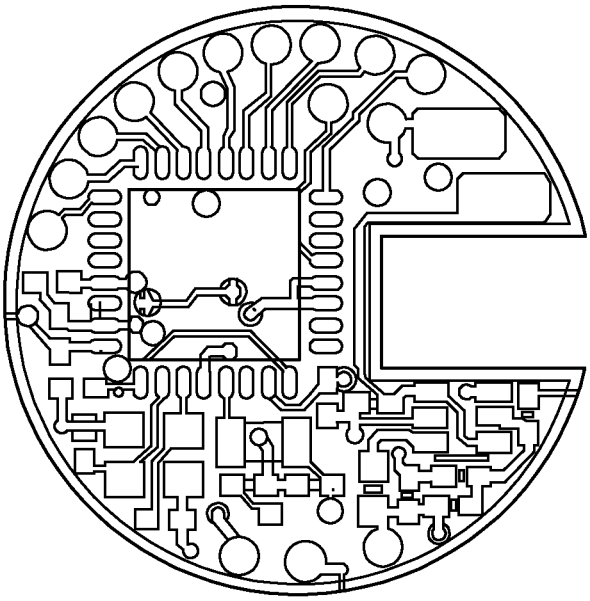
FIGS. 10A and 10B respectively show top and bottom views of a DoB PCB layout.
Figure 10B:
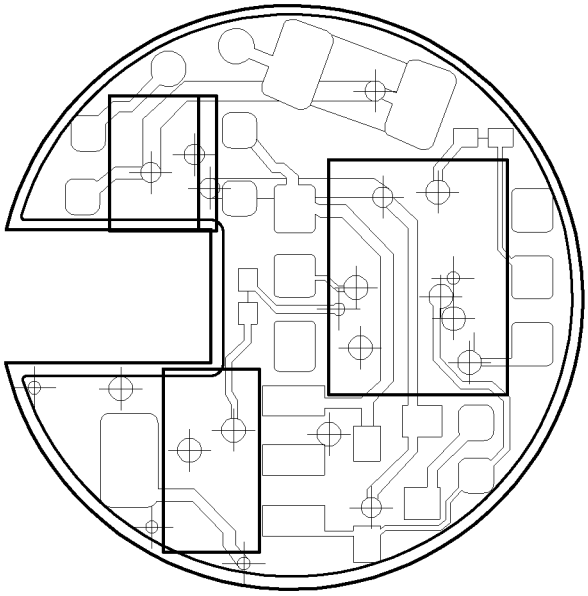

FIGS. 6A to 6C show views of a space model of DoB circuitry and battery inside a E27 light bulb base, wherein the communications board 70 and the circular dimming board 90 are separate, located either side of battery 80. The communications board 7 may be a Bluetooth device. FIG. 8 shows schematically a Bluetooth circuit for the DoB. The MCU 95 is located in space 50. FIG. 9 shows schematically a microcontroller (MCU) circuit for the DoB. A DoB PCB layout is shown in FIGS. 10A and 10B.

Figure 18:
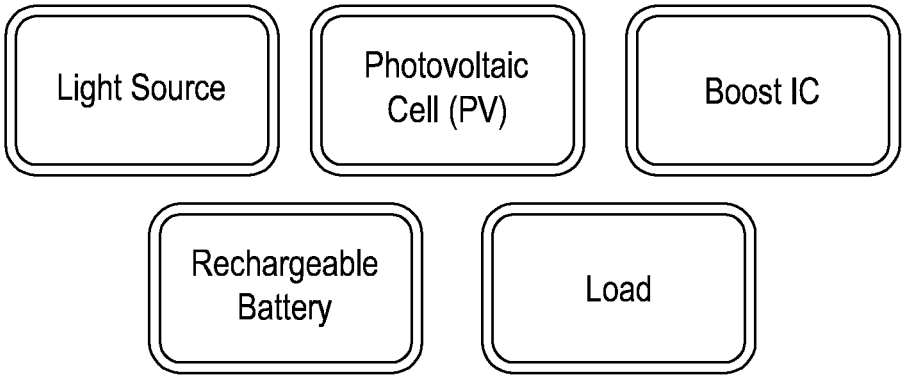
FIG. 18 shows a PV charging circuitry example.

Power harvesting for trickle charging a battery uses a rechargeable battery, a charging circuit, and a source of energy. In an example, a Photovoltaic cell (PV) is used as energy source, directly harvesting energy from the light emitted from the bulb. The typical hardware blocks required for charging battery from a PV are shown in FIG. 18: light source, PV, Boost IC, rechargeable battery and load (DoB and Communication electronics).

The Photovoltaic Cell (PV) draws power from a light source such as the LED bulb according to aspects of the invention. Power from the PV is fed into input of Boost IC for converting to usable form (e.g. 4.2V). The output of Boost IC is used to charge a battery. The battery and Boost IC is used to power load (e.g. DoB and Communications electronics).

The PV cell component is preferably a PV solar tape. For example, PV tape may be provided in rolls, preferably separated in 10 cm sections. PV solar tape is a flexible organic solar cell foil with optional semi-transparent lined adhesive on the front or backside and functions as a "solar sticker".

Figure 19:
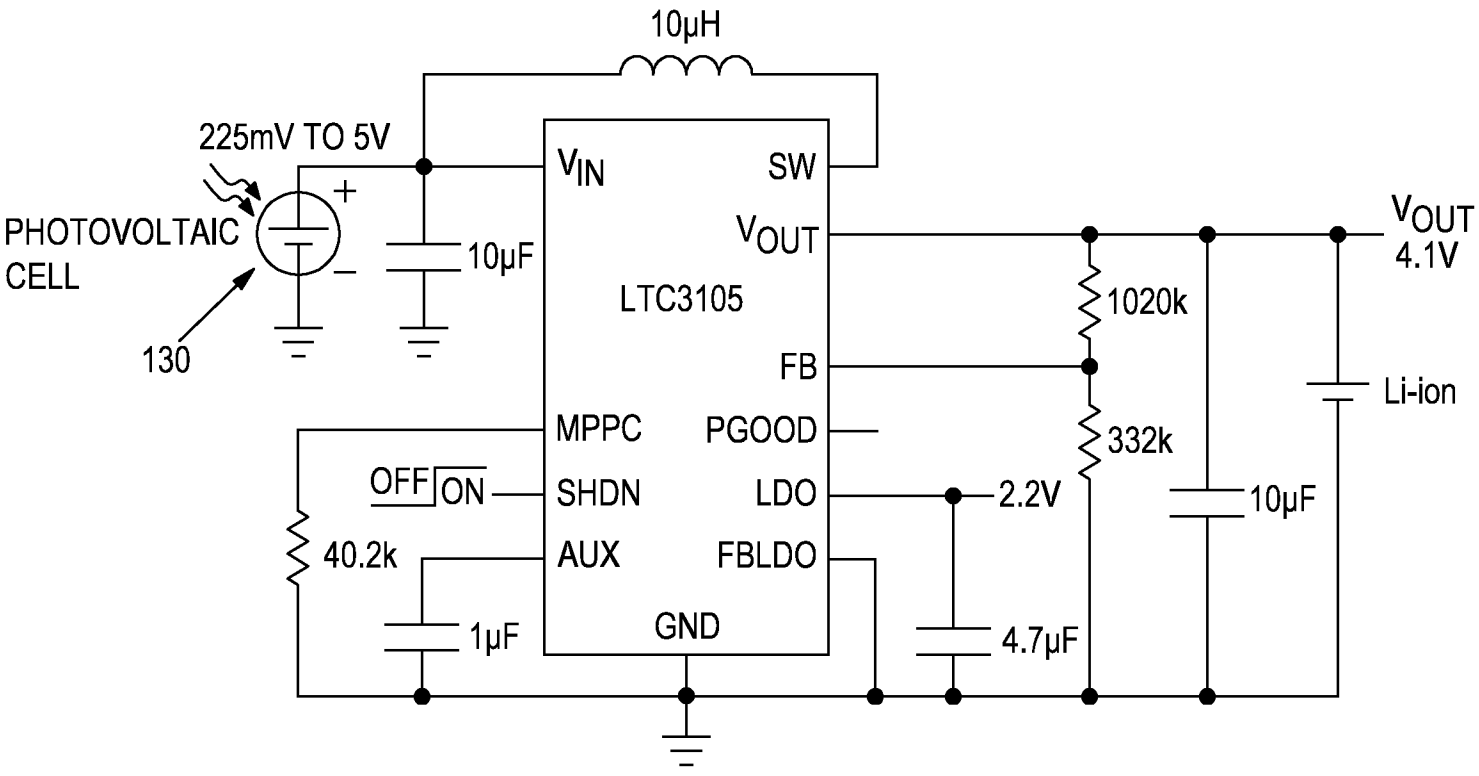
FIG. 19 shows an example circuit using PV cell and DoB ("Boost Intergrated Circuit, IC"). The title of this figure may be: LTC3105 400 mA Step-Up DC/DC Converter with Maximum Power Point Control and 250 mV Start-Up.
Figure 20:
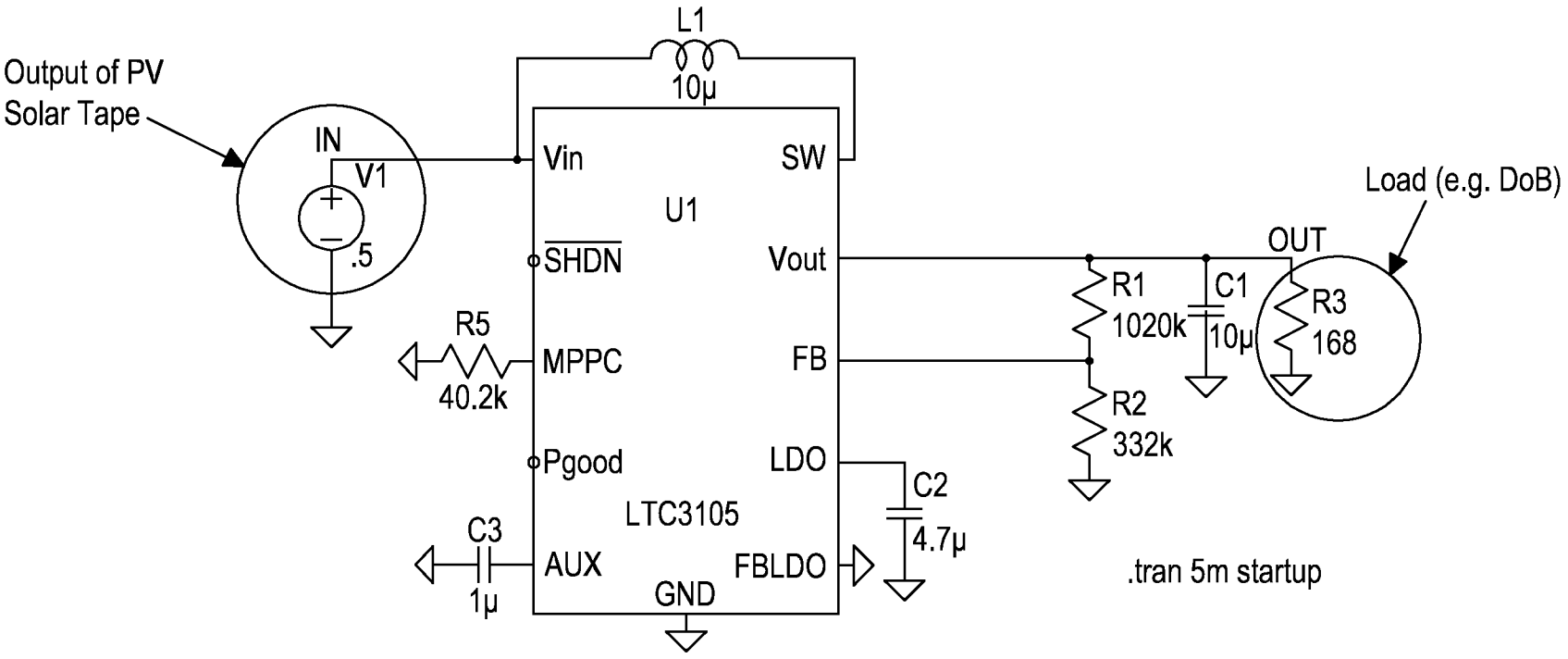
FIG. 20 shows an example Boost Integrated Circuit (IC) simulated schematic.

A simulation of the solution and required hardware blocks was performed using a Boost IC. The diagram shown in FIG. 19 shows a typical application of Boost IC, containing the following hardware blocks: a PV cell 130 and battery. In practice, the load (DoB and Communication electronics) would be connected to the point Vout in FIG. 19. Further details of this circuit may be obtained from: http://cds.linear.com/docs/en/datasheet/3105fb.pdf Embodiments Employing PV (One or More Photovoltaic Cells, Strips or Tapes)

In preferred embodiments, the light source is an LED light source. Preferably, the LED light source has one or more filaments.

In a preferred embodiment, the light emitting device incorporates a base assembly configured to fit a light-bulb socket, the base assembly comprising a hollow portion; a LED control circuit for dimming the LED light source, the LED control circuit being entirely housed within the hollow portion. In a preferred embodiment, operatively connected to the control circuit or to the battery of a control circuit, a PV cell or tape is provided.

Figure 26:
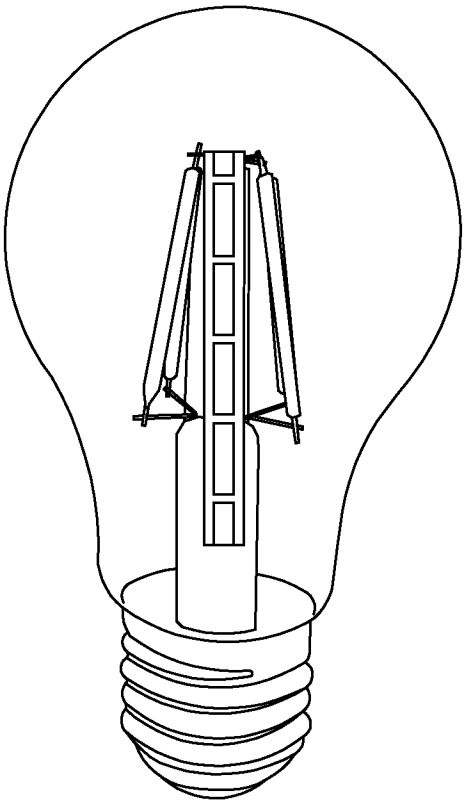
FIG. 26 shows a bulb in side elevation with a PV strip on the stem.
Figure 25:
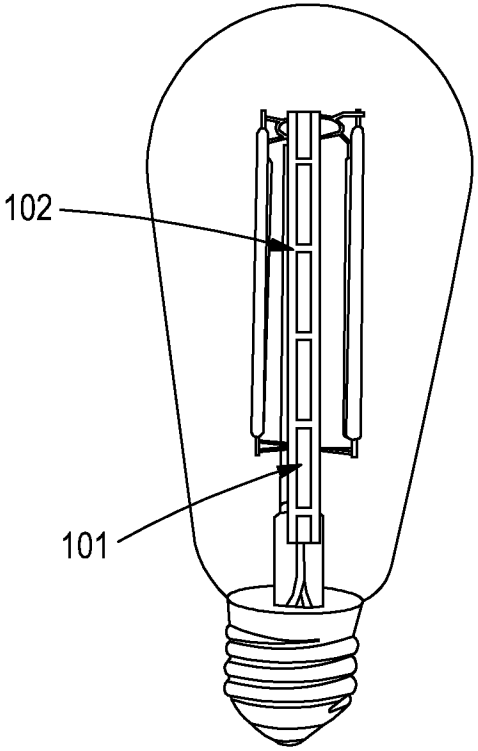
FIG. 25 shows a bulb in side elevation with a PV strip on the stem.

The provision of the PV tape is optionally within the transparent portion of the light emitting device such as within the glass of a bulb. Optionally, the PV tape or strip is secured to the bulb's stem as shown in FIGS. 25 and 26 where PV strips 101 are provided. These may be coupled in addition with appropriate mounting means 102. FIG. 25 shows an arrangement of parallel filaments with the PV strip located relatively inwards. FIG. 26 shows an arrangement of diverging filaments with the PV strip located relatively radially inwards.

Figure 28:
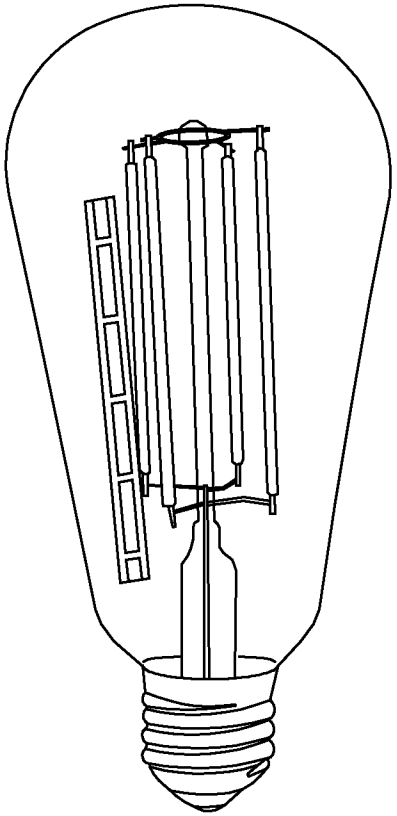
FIG. 28 shows a bulb in side elevation with a PV strip on the side of the transparent portion of a bulb.
Figure 27:
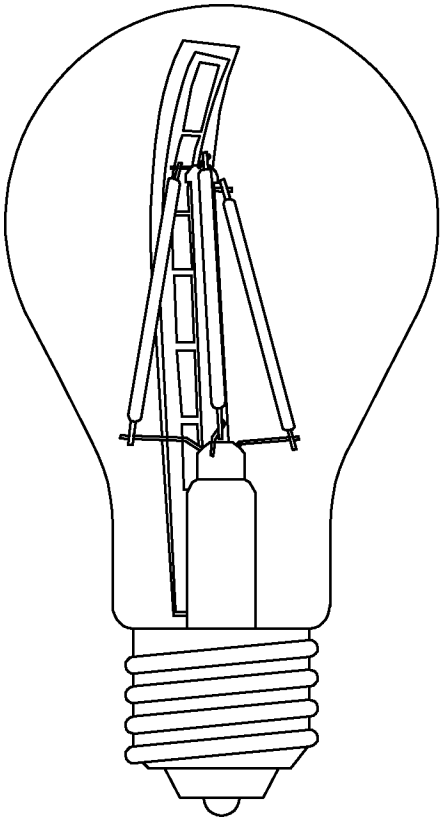
FIG. 27 shows a bulb in side elevation with a PV strip on the side of the transparent portion of a bulb.

Optionally, the PV strips or tape may be secured to the inside of the transparent portion of the bulb for example as shown in FIGS. 27 and 28. Appropriate wiring or windings are envisaged in the various embodiments between the PV tapes and the control circuit which may be provided within the base of the bulb or within the housing of a lamp.

Optionally, the PV cells comprise a plurality of strips extending in the vertical direction as shown for example in FIGS. 25 to 28.

Figure 30:
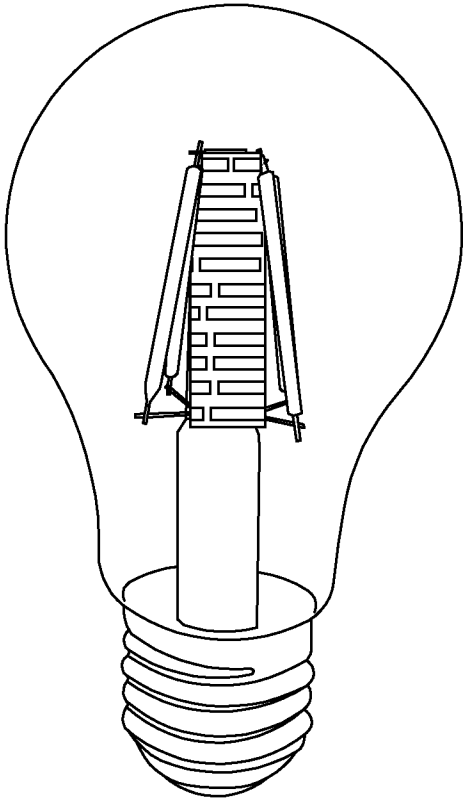
FIG. 30 shows a bulb in side elevation with a PV strip on the stem.
Figure 29:
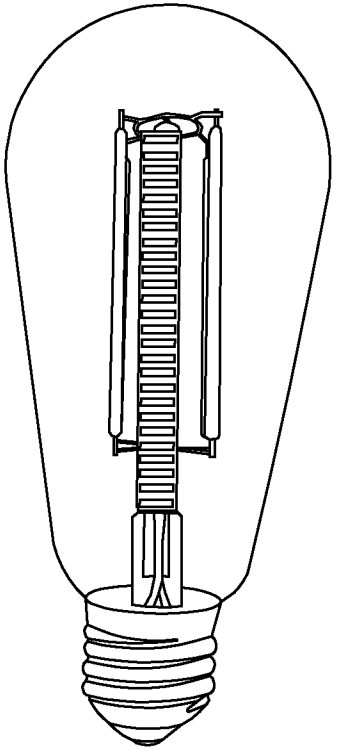
FIG. 29 shows a bulb in side elevation with a PV strip on the stem.

Optionally, the PV cells comprise a plurality of strips extending in the horizontal or transverse direction as shown in FIGS. 29 and 30.

Figure 32:
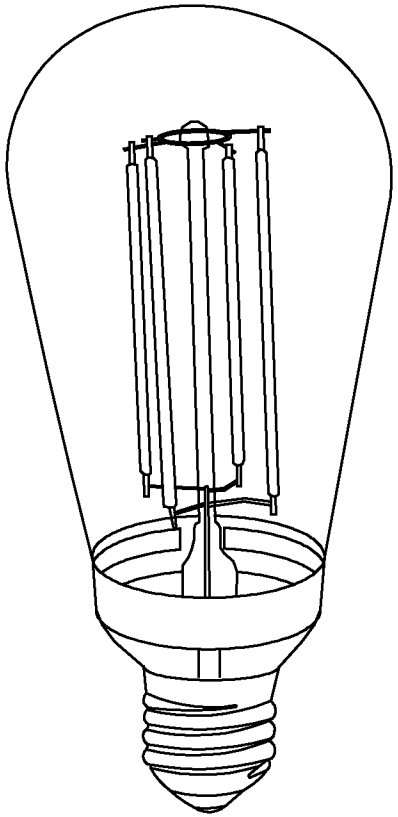
FIG. 32 shows a bulb in side elevation with a PV strip around the rim of the base of the bulb.
Figure 31:
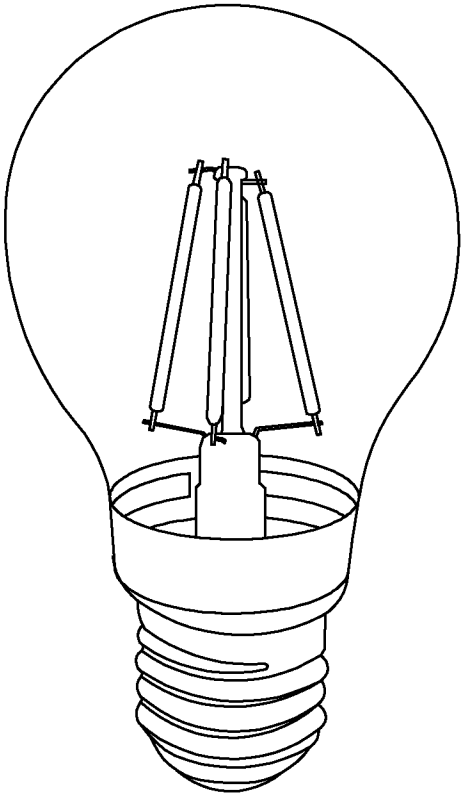
FIG. 31 shows a bulb in side elevation with a PV strip around the rim of the base of the bulb.

Optionally, the PV strips are circumferential disposed and may for example be disposed around an upper portion of the housing of the base of the bulb. This may for example take the configuration as shown in FIGS. 31 and 32.

Figure 33:
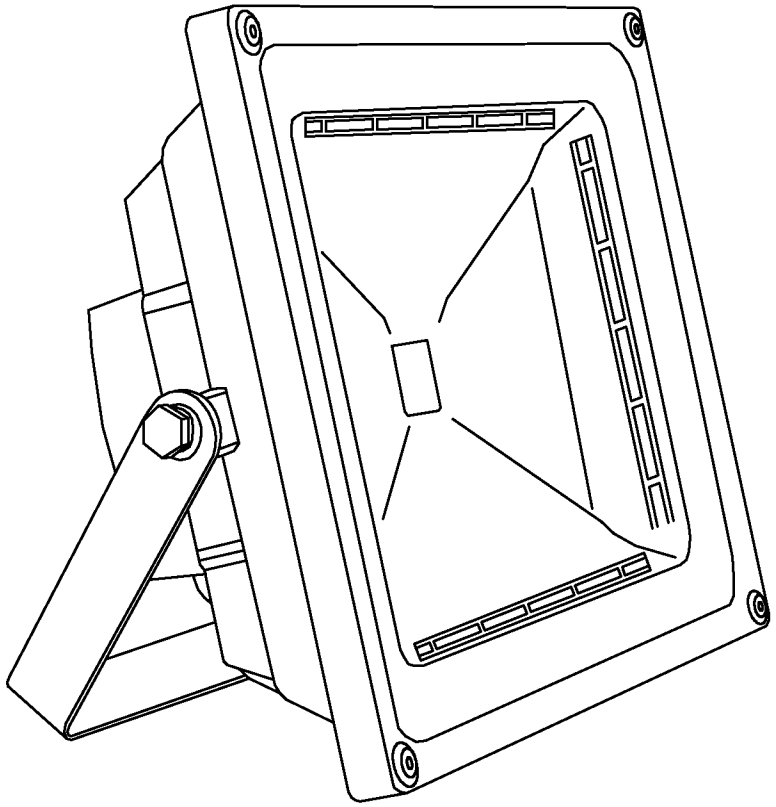
FIG. 33 shows a lamp in side elevation with a PV strip.

Optionally, the PV strips are provided on the reflector surfaces of a lamp as shown in FIG. 33.

Figure 34:
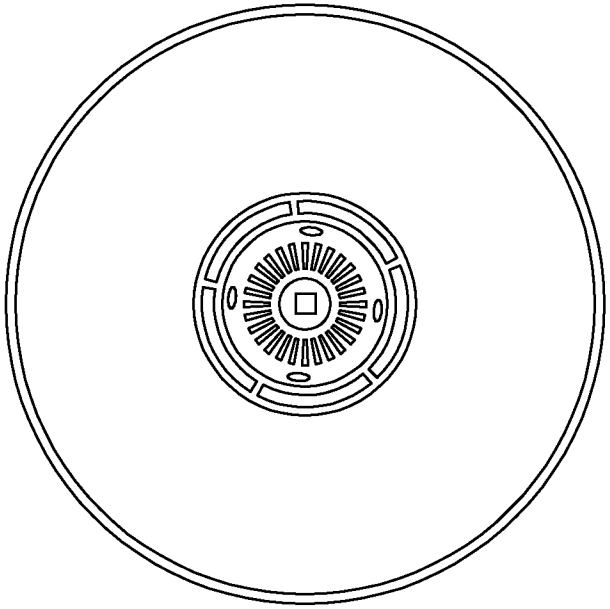
FIG. 34 shows a spot light in elevation with a PV strip.

Optionally, the PV strips are provided on the reflector surfaces of a spot light as shown in FIG. 34. Optionally, each strip may be attached by an adhesive or other means of attachment.

Antenna

In any of the embodiments described herein, an antenna is optionally envisaged which may be external from the base of the bulb sufficiently to receive signals from a wireless device such as a mobile phone or other input device. In that sense, the antenna itself doesn't form part of the housed control circuitry but operates in conjunction with it. The antenna may be secured to the side of the bulb or to the outside surface of the base as appropriate.

Powering Electronics Externally

In alternative embodiments, it is possible to power the DoB and communications electronics from an external source such as USB, transformer or adaptor. All three options may be considered as part of a universal dimmer solution.

Power from a USB socket and cable could be used to provide power to the DoB and Communications electronics. This may be achieved for example by wiring a micro socket to the V_IN and GND1 test points on the DoB electronics. An off the shelf adapter board such as the one below or custom PCB would need to be developed and added to the DoB electronic design. A standard micro USB cable could then be connected between this socket and a standard USB adapter to provide power to the DoB and communications electronics.

Powering via a transformer is an alternative solution akin to having a combination of an external unit and the bulbs. For example, An AC/DC Converter could be used to power the DoB and communications electronics directly from mains (230V). The external unit in effect houses the step down power circuitry. It has the advantage over the provision of a step down power circuit as it does not impact the goal of dimming electronics in the board, but does mean that wiring the bulbs and siting the transformer would not make the offering easily installable and retrofittable.

A more generic option would be to use an off the shelf power adaptor and barrel connector wired to the DoB and communications electronics.

All these three power options make use of a transformer to convert for example 230V to 5V. Powering using a transformer advantageously removes the need for any connectors as it can be wired directly to the DoB and communication electronics. An advantage is that it can be wired directly into an existing lighting circuit, therefore the DoB electronics can be powered in parallel to the bulbs that they are controlling.

Powering Electronics from the Driver Circuitry

In alternative embodiments, the DoB and communications board may be powered from driver circuitry elements either internally or externally from the board. Taking power from inside the bulb means access to neutral and both sides of the mains which makes the stepping down from mains power to the 3V power easier to achieve. The essence for this requirement is similar to that given above for the solar charging input in that the charge could be held in a capacitor or battery. The level and amount of the charge would change and may in some instances be negligible (e.g. if it were possible to utilise the power directly with minimal step down).

Inductorless Switching Regulator

Powering the DoB and Communications board may be powered from an IC without using a transformer or inductor, which are typically physically large components. A transformer is typically the standard method used when stepping down from 230VAC to a smaller DC voltage. However, there are ICs that make use of alternative methods to step down voltage. One such component is the SR086.

Figure 21:
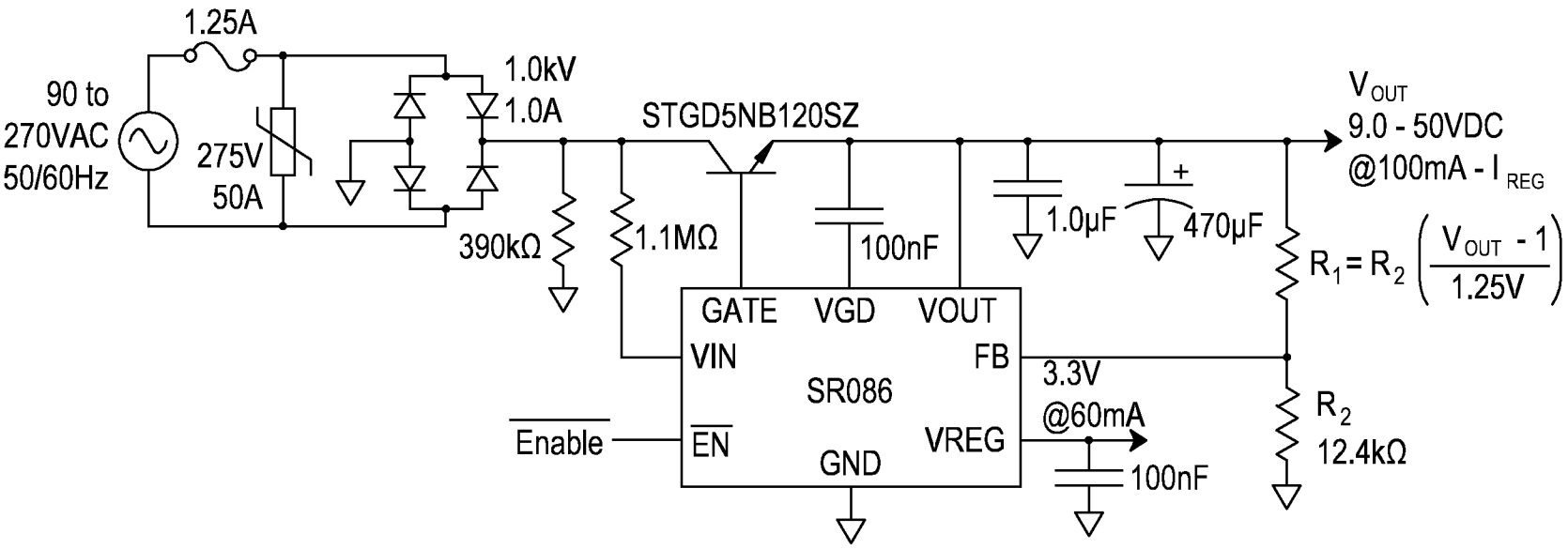
FIG. 21 shows a circuit for powering the DoB with an inductorless switching regulator. The title of this figure may be: SR086/SR087 Adjustable Offline Inductorless Switching Regulators.

A typical application circuit is shown in FIG. 21, comprising 4 resistors, 4 capacitors, 1 bridge rectifier, a fuse, a visitor, a transistor and the IC (SR086) itself. Applying this to the DoB, the bridge rectifier and fuse can be ignored as they are already included as part of the DoB schematic. Using a value of 82K for R1, this would set the value of Vout to 9.2V. Vout is internally used in the SR086 to power a 3V3 linear regulator which has a 60 mA output current. This would provide more than enough headroom to power the DoB circuitry. Further details with regard to FIG. 21 may be obtained from the following website: http://ww1.microchip.com/downloads/en/DeviceDoc/20005544A.pdf In terms of size, the largest components in this circuit would be the regulator itself (5 mm×6.2 mm), the transistor (11.5 mm×6.7 mm) and the 470 uF capacitor which has a 10 mm diameter. The other components in the typical application need to be carefully selected in order to have the right power ratings for the application but would be physically smaller than these three main parts. The 470 uF could also be reduced; this value was chosen to accommodate a load of 100 mA on Vout, whereas in practice the DoB represents a maximum load of 25 mA.

Figure 22:
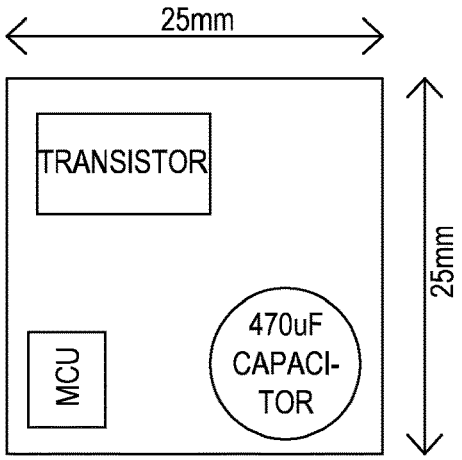
FIG. 22 shows example board sizes.

FIG. 22 indicates an estimate of the required board size (square with 25 mm sides) for accommodating this solution. Accordingly, the components could fit on a board size of 625 $mm^2$ (just under 1 square inch). The usable surface area of a board this size would in fact be 1250 $mm^2$ as both sides of the board can be used to fit components.

The size of the board required to support this solution is a lot smaller than a similar transformer based circuit. Furthermore, although the component count is similar, the physical sizes of each component allow for greater flexibility in how the board is designed at the layout stage.

The Universal Dimming Interface

Figure 23:
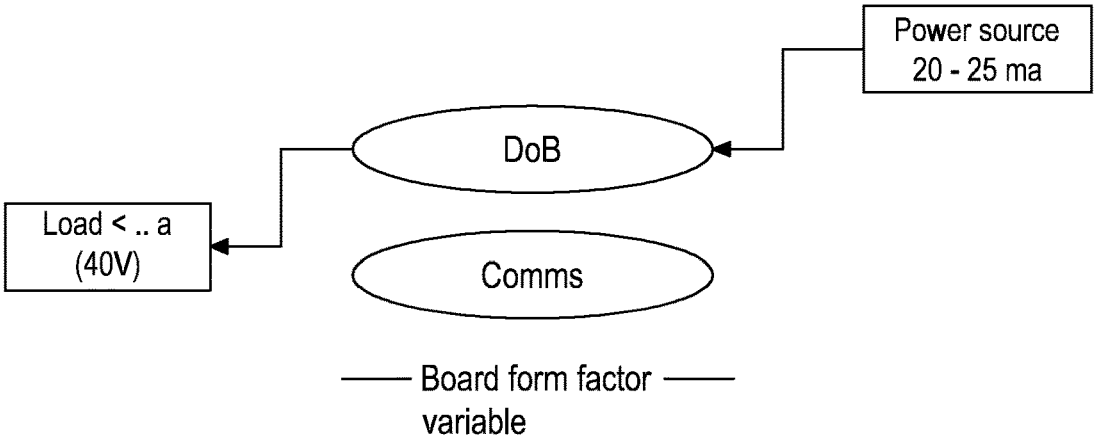
FIG. 23 shows elements of a universal dimming interface.

A universal dimmer interface includes dimming, communication, and power source elements. Each dimmer/communications combination would require powering from one power source. FIG. 23 shows the components of a universal dimming interface: a DoB, a power source (e.g. 20-25 ma) and a load (e.g. 40V), and a communications board/electronics. The power source which drives the electronics is independent from the electronics. The DoB is load in this example is set at 128 W limited by a bridge rectifier.

The design of the DoB was described above. The dimensions of the DoB, whilst relevant to embodiments that fit in a light bulb socket (i.e. E27), are not essential here and it will be appreciated that they can vary.

The design for the communication board based on the use of Bluetooth and for use in conjunction with the trialed DoB was described above. The dimensions of the board as noted above apply. However, the fit of the antenna will need to be considered in any one specific design.

Additional communications options and their fit with the design have been considered:

1) Wireless network option

Bluetooth mesh—the Bluetooth module trialed is mesh capable.

Space for alternative or additional mesh networks has been allowed on the communications board.

2) Wired communications option

The requirement for integration of DALI, DMX has been considered.

These options would require power to be supplied through to the DoB. External power options have been considered and recommended and these could be used to facilitate this functionality.

The MCU has been chosen so that it could accommodate a DALI stack and the option of adding in the software required for DALI and DMX control.

Combinations of the communications options are envisaged to provide generality. For example, a wired DALI connected solution could then be coupled with a Bluetooth wireless solution. Each could use the same dimmer board.

The power source preferably provides a voltage of 4.2V and current: 20-25 mAh. For a stand-alone option, i.e. where the DoB electronics is self-powered, a means of supplying power from a constant rechargeable source is required. Essentially this will require a capacitor to store change and a rechargeable battery has been used in the demonstrator. The battery in this example has a capacitance of 75 mAh and therefore in parallel with charging circuitry will provide 3 hours of headroom and on a constant charge will power the DoB and Communications electronics. This is sufficient to provide the constant power to the battery over a battery life which could then power the bulb for a typical life-time. A number of methods have been investigated for the provision of this constant changing, one using a solar source as described above. The inventors found that a load of 64 W (8 bulbs attached) can be fully dimmed and brightened, with a predicted maximum of 128 W of bulbs.

Figure 24:
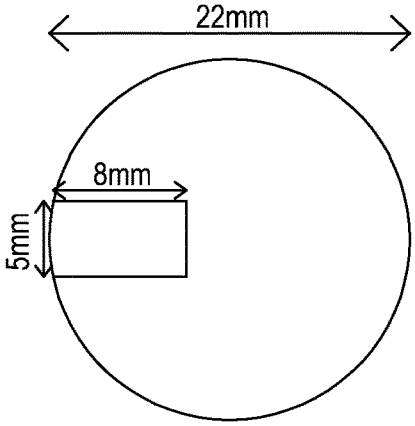
FIG. 24 shows example DoB measurements.

FIG. 24 shows example DoB measurements. The usable surface area of both sides of the board is approximately 680.2 $mm^2$. Given that the board is densely populated, this can be taken as the minimum surface area required to house the components that make up the DoB. This would mean that components could be placed on a board that contains an equivalent surface area.

The DoB prototype has been designed with the E27 (27 mm) bulb in mind. The size reflects the outer dimensions of the thread. An E26 (26 mm) therefore has an external diameter of 26 mm. In this example, the DoB is designed to fit inside the holder. The inside measurement is 26 mm for the E27 and presumed 25 mm for the E26. The DoB with a diameter of 22 mm theoretically fits.

In general however, the shape and dimensions of the board can be varied, and, in addition, boards can be stacked within a space. It is therefore sensible to consider the finite limit on the board area, or real estate, required for components to fit. EMC, antenna, rf and safety considerations also need to be taken into account. Each implementation can be customised. As a starting point, the basic real-estate required for the DoB electronics as a minimum is set as that designed for the E27 bulb at 680.2 mm2.

The invention claimed is:

1. A dimmable light-emitting device, comprising:

a LED light source;

a base assembly configured to fit a light-bulb socket, the base assembly comprising a hollow portion;

a LED control circuit for dimming the LED light source, the LED control circuit being entirely housed within the hollow portion;

a power source electrically connected to the LED control circuit, wherein the LED control circuit is powered exclusively by the power source;

wherein said base assembly comprises a circumferential wall configured to fit a light-bulb socket; said circumferential wall having at its distal extremity a rim; said rim defining an end of said base assembly; a first board being exposed for receiving wireless communications through the space defined by said rim; and a second board located behind said first board and incorporating said LED control circuit for dimming said LED light source, wherein the power source is located between the first and second boards; both the power source and the second board being located below the rim of said circumferential wall.

2. A dimmable light-emitting device according to claim 1, wherein said LED light source comprises one or more LED filaments.

3. A dimmable light-emitting device according to claim 2, wherein the base assembly is configured to fit an E26 or E27 light bulb socket.

4. A dimmable light-emitting device according to claim 1, wherein the power source is a photovoltaic cell facing the LED light source.

5. A dimmable light-emitting device according to claim 1, wherein the first board has DALI compatibility.

* * * * *